US006881109B2

(12) United States Patent
Matsuda et al.

(10) Patent No.: US 6,881,109 B2
(45) Date of Patent: Apr. 19, 2005

(54) JET-PROPULSION WATERCRAFT

(75) Inventors: Yoshimoto Matsuda, Kobe (JP); Yasuo Okada, Kobe (JP)

(73) Assignee: Kawasaki Jukogyo Kabushiki Kaisha, Kobe (JP)

( * ) Notice: Subject to any disclaimer, the term of this patent is extended or adjusted under 35 U.S.C. 154(b) by 0 days.

(21) Appl. No.: 10/371,644

(22) Filed: Feb. 21, 2003

(65) Prior Publication Data

US 2003/0162450 A1 Aug. 28, 2003

(30) Foreign Application Priority Data

Feb. 22, 2002 (JP) ..... 2002-046043

(51) Int. Cl.[7] ..... B63H 11/00
(52) U.S. Cl. ..... 440/39; 440/88 M
(58) Field of Search ..... 440/38, 39, 88 C, 440/88 M

(56) References Cited

U.S. PATENT DOCUMENTS 5,366,397 A * 11/1994 Suganuma et al. ..... 440/39
5,472,359 A * 12/1995 Allbright et al. ..... 440/38
5,713,769 A * 2/1998 Jones ..... 440/38
6,036,556 A * 3/2000 Baker et al. ..... 440/38
6,171,158 B1 * 1/2001 Henmi et al. ..... 440/38
6,659,816 B1 * 12/2003 Fuse ..... 440/38

FOREIGN PATENT DOCUMENTS

JP 10-119883 5/1998

* cited by examiner

*Primary Examiner*—Lars A. Olson
(74) *Attorney, Agent, or Firm*—Alleman Hall McCoy Russell & Tuttle LLP

(57) ABSTRACT

Disclosed is a jet-propulsion watercraft having a simple structure for drawing water as cooling water, the inside of which may be cleaned easily. The watercraft typically comprises an engine, a water jet pump driven by the engine, a two-part pump casing, at least one water drawing passage provided so as to communicate with an inside of the water jet pump in a portion where the two parts of the pump casing are connected to each other, and a component cooled by cooling water taken through the water drawing passage.

22 Claims, 18 Drawing Sheets

JET-PROPULSION WATERCRAFT

BACKGROUND OF THE INVENTION

1. Field of the Invention

The present invention relates to a jet-propulsion watercraft such as a personal watercraft (PWC) which ejects water rearward and hydroplanes as the resulting reaction. More particularly, the present invention relates to a water drawing structure in a water jet pump, to supply water taken from an inside of the water jet pump for propulsion to an engine or the like as cooling water.

2. Description of the Related Art

In recent years, so-called jet-propulsion personal watercraft (hereinafter, also referred to as a personal watercraft) have been widely used in leisure, sport, rescue activities, and the like. The jet-propulsion watercraft is configured to have a water jet pump that pressurizes and accelerates water sucked from a water intake generally provided on a bottom surface of a hull and ejects it rearward from an outlet port. Thereby, the watercraft is propelled.

In the jet-propulsion watercraft, a steering nozzle provided behind the outlet port of the water jet pump is swung either to the right or to the left by operating a bar-type or a round-type steering handle to the right or to the left, to change the ejection direction of the water to the right or to the left, thereby turning the watercraft to the right or to the left.

In the jet-propulsion watercraft, to cool components requiring cooling, such as an engine and an exhaust system, water is typically taken from a positive-pressure region inside the water jet pump and is directly or indirectly led to the components to cool them.

The water flowing through the inside of the water jet pump often contains unwanted substances such as sand, stones and water borne plants. It is therefore necessary to remove these substances from the water when taken from the inside of the water jet pump. To this end, Japanese Laid-Open Patent Application Publication No. Hei 10-119883 discloses that a porous filter is provided in an opening in a portion of the water jet pump from where the water is taken.

When cleaning the filter provided in the opening, a cover member provided over the filter needs to be removed. Since the cover member is located inside and apart from an opening of a pump room containing the water jet pump, cleaning of the filter is troublesome.

SUMMARY OF THE INVENTION

The present invention addresses the above-described condition, and an object of the present invention is to provide a jet-propulsion watercraft having a simple structure for drawing water for use as cooling water from a water jet pump. A further object of the invention is to provide a jet-propulsion watercraft in which an inside of the structure is easy to clean.

According to the present invention, there is provided a jet-propulsion watercraft, comprising: an engine; a water jet pump driven by the engine; two parts constituting a pump casing of the water jet pump; at least one water drawing passage provided so as to communicate with an inside of the water jet pump in a portion where the two parts are connected to each other; and a component cooled by water as cooling water taken through the water drawing passage, the component being, for example, an engine component.

In this structure, the structure for drawing the cooling water is obtained without an increase in the number of parts, merely by setting a relative dimensional relationship between the parts constituting the water jet pump so as to form the water drawing passage in a connecting face between these parts. Besides, the water drawing passage is suitably sized to have a function of filtering the water containing unwanted substances.

Preferably, the water drawing passage may be provided in a portion where a front casing of the water jet pump is connected to a rear casing of the water jet pump for leading pressurized water rearward. In this structure, the front casing may contain an impeller of the water jet pump, and the rear casing may have a pump nozzle of the water jet pump. Also, the water drawing passage may be formed in the shape of a slit in a connecting face between the front casing and the rear casing.

Preferably, the jet-propulsion watercraft may further comprise: a water reserving passage located radially outward of the water drawing passage so as to communicate with the water drawing passage and surrounded by an outer wall, wherein a cooling water outlet for drawing the water is provided in the outer wall to supply the water for use as cooling water to the component. In this structure, the cooling water is taken in a stable condition from the water reserving passage. Also, in this structure, the outer wall of the water reserving passage at least partially may have a removable wall capable of moving in a longitudinal direction of the watercraft. The water reserving passage is located inward of the removable wall and may be provided with a baffle plate. Further, the water reserving passage may be provided with a filter member. A double filter structure comprised of the baffle plate and the filter member is capable of filtering the water containing small substances flowing through the water drawing passage.

Preferably, the water drawing passages may be provided at plural positions intermittently in a circumferential direction of the water jet pump. In this structure, the water drawing passages provided at plural positions communicate with one another through the water reserving passage.

Preferably, an opening of the water drawing passage may be located in an upper portion of the pump casing and above a center of the water jet pump.

By providing the water drawing passages intermittently at plural positions, the size of each of the water drawing passages may be reduced. Therefore, large unwanted substances such as water borne plants are prevented from entering the water drawing passages.

According to the present invention, there is provided a jet-propulsion watercraft comprising: an engine; a water jet pump driven by the engine; an opening provided in a casing of the water jet pump to communicate with an inside of the pump; a water reserving passage communicating with the opening; a component cooled by water taken through the opening, the component including the engine; a cover provided over the water reserving passage from outside; a cooling water outlet provided in the cover, to supply the water as cooling water to the component; and a removable wall constituted by at least part of the cover that is removable by being moved in a longitudinal direction of the watercraft.

In this structure, the substances can be easily removed by removing the removable wall from outside the cover, and therefore the water reserving passage inside the cover can be easily cleaned. In particular, the removable wall provided at the rear portion of the water jet pump can be easily removed from outside the watercraft, because the rear portion of the water jet pump is generally exposed toward outside the watercraft (hull).

Preferably, the water reserving passage located inward of a wall portion of the cover having the removable wall may be provided with a baffle plate. The baffle plate prevents entry of the substances entering through the opening. In this structure, the baffle plate may be comprised of a plate member having a slit.

Preferably, the watercraft may further comprise a filter member provided between the opening and the cover. The filter member is capable of filtering the water containing the substances entering through the opening and can be easily cleaned.

Preferably, the opening may be slit-shaped. In this structure, the slit-shaped opening prevents the substances from entering the water reserving passage.

Preferably, the opening may be provided in a connecting face between two parts constituting the casing of the water jet pump. Such a structure avoids a substantial increase in the number of parts and the number of processes used in manufacturing the water jet pump.

Preferably, the removal wall may be provided at a position of the water jet pump so as to be accessible from outside the watercraft, for example, at a position exposed outside the watercraft. Such a structure is advantageous in that the substances residing inside the water reserving passage can be easily removed by removing the removable wall from outside the watercraft.

According to the present invention, there is provided a jet-propulsion watercraft adapted to be propelled by a water jet pump driven by an engine, and to cool a component of the watercraft by using water drawn from an inside of the water jet pump, the watercraft being provided with a water drawing passage in a wall face of a pump casing, wherein the water drawing passage is located in an upper portion of the pump casing and above a center of the water jet pump, to allow the water to be taken therethrough.

In this structure, heavy substances such as sand are prevented from entering the water drawing passage, since it is located in the upper portion of the pump casing and above the center of the pump casing.

Preferably, the water drawing passage may be provided within a range of 60 degrees from an uppermost position of the pump casing toward each of clockwise and counter-clockwise directions. Such a structure further prevents entry of the substances.

The above and further objects and features of the invention will be more fully be apparent from the following detailed description with accompanying drawings.

BRIEF DESCRIPTION OF THE DRAWINGS

FIGS. 2A and 2B are views showing a structure of a connecting portion between two parts of a casing of the water jet pump marked by a dashed line in FIG. 1, according to a first embodiment, in which FIG. 2A is a partial side cross-sectional view and FIG. 2B is a view taken in the direction of arrows along line IIb—IIb in FIG. 2A;

FIGS. 3A and 3B are views showing a structure of a connecting portion between the two parts of the casing of the water jet pump marked by the dashed line in FIG. 1, in which FIG. 3A is a partial side cross-sectional view and FIG. 3B is a view taken in the direction of arrows along line IIIb—IIIb in FIG. 3A;

FIGS. 4A and 4B are views showing a structure of a connecting portion between the two parts of the casing of the water jet pump marked by the dashed line in FIG. 1, according to a third embodiment, in which FIG. 4A is a partial side cross-sectional view and FIG. 4B is a view taken in the direction of arrows along line IVb—IVb in FIG. 4A;

FIGS. 5A and 5B are views showing a structure of a connecting portion between the two parts of the casing of the water jet pump marked by the dashed line in FIG. 1, according to a fourth embodiment, in which FIG. 5A is a partial side cross-sectional view and FIG. 5B is a view taken in the direction of arrows along line Vb—Vb in FIG. 5A;

FIGS. 6A and 6B are views showing a structure of a connecting portion between the two parts of the casing of the water jet pump marked by the dashed line in FIG. 1, according to a fifth embodiment, in which FIG. 6A is a partial side cross-sectional view and FIG. 6B is a view taken in the direction of arrows along line VIb—VIb in FIG. 6A;

FIGS. 7A and 7B are views showing a structure of a connecting portion between the two parts of the casing of the water jet pump marked by the dashed line in FIG. 1, in which FIG. 7A is a partial side cross-sectional view and FIG. 7B is a view taken in the direction of arrows along line VIb—VIb in FIG. 7A;

FIGS. 9A and 9B are views showing a structure of a water jet pump of the personal watercraft according to a seventh embodiment, in which FIG. 9A is a partial side cross-sectional view of a rear end portion of the water jet pump including the portion marked by the dashed line in FIG. 1, and FIG. 9B is a view taken in the direction of arrows along line IXb—IXb in FIG. 9A, showing a slit constituting the water drawing passage;

FIGS. 10A and 10B are views showing a structure of a water jet pump of the personal watercraft according to an eighth embodiment, in which FIG. 10A is a partial side cross-sectional view of a rear end portion of the water jet pump including the portion marked by the dashed line in FIG. 1, and FIG. 10B is a view taken in the direction of arrows along line Xb—Xb in FIG. 10A;

FIGS. 16A and 16B are side cross-sectional views showing a relationship between the water jet pump and the watercraft, wherein FIG. 16A is a side cross-sectional view showing a relationship between a pump room that contains the water jet pump and the water jet pump and FIG. 16B is an enlarged cross-sectional view showing a detailed structure;

DETAILED DESCRIPTION OF THE PREFERRED EMBODIMENTS

Hereinafter, preferred embodiments of a jet-propulsion watercraft of the present invention will be described with reference to the accompanying drawings.

Figure 17:
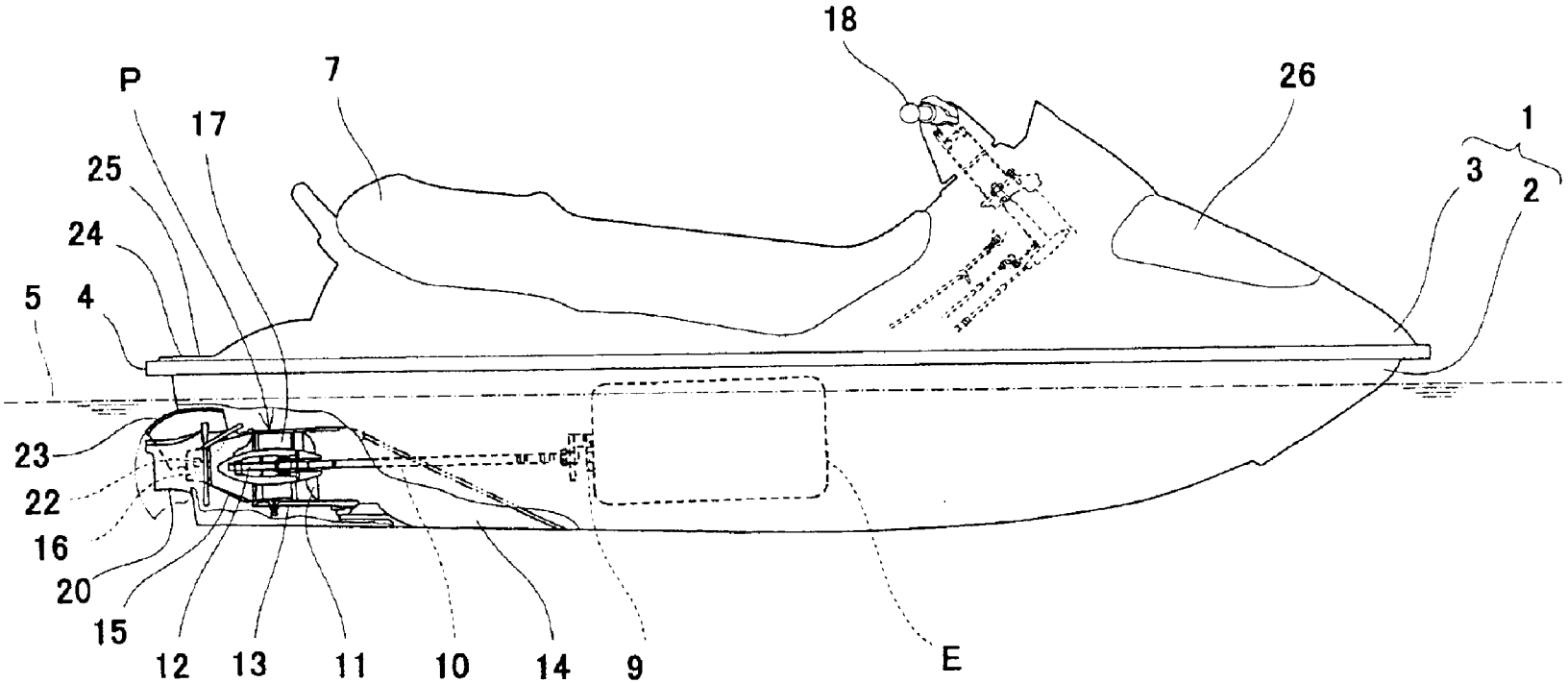
FIG. 17 is a side view showing a jet-propulsion personal watercraft to which the present invention is applied.
Figure 18:
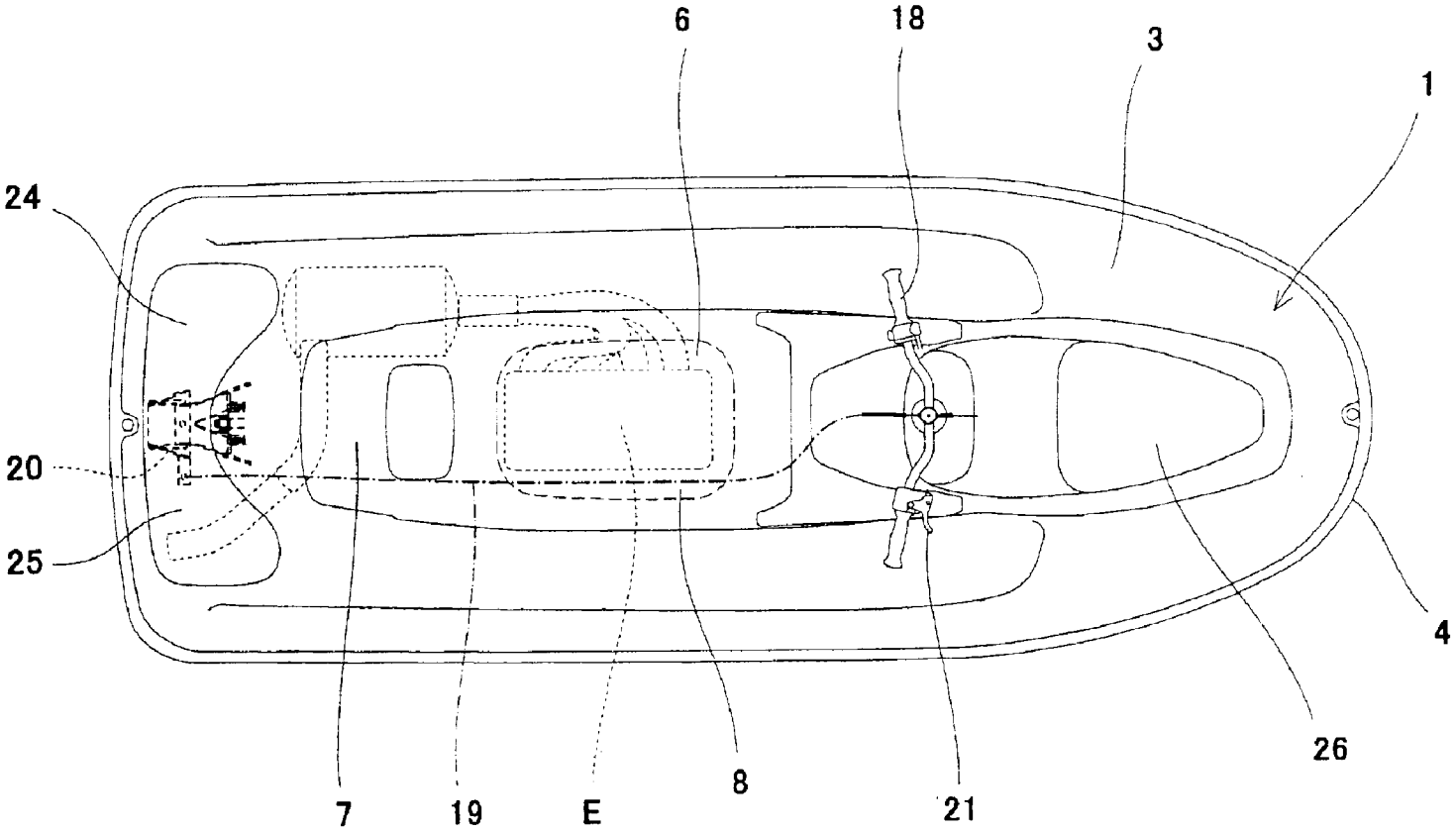
FIG. 18 is a plan view showing the jet-propulsion personal watercraft.

Referring now to FIGS. 17 and 18, a body 1 of the jet-propulsion personal watercraft comprises a hull 2 and a deck 3 covering the hull 2 from above. A line at which the hull 2 and the deck 3 are connected over the entire perimeter thereof is called a gunnel line 4. In this embodiment, the gunnel line 4 is located above a waterline 5 of the personal watercraft.

As shown in FIG. 18, an opening 6, which has a substantially rectangular shape seen from above, is formed at a relatively rear section of the deck 3 over an upper surface of the body 1 such that it extends in the longitudinal direction of the body 1, and a straddle-type seat 7 is provided over the opening 6.

An engine E is disposed in a chamber (engine room) 8 surrounded by the hull 2 and the deck 3 below the seat 7 and having a convex shape in a cross-section of the body 1. The engine E has multiple cylinders (e.g., four cylinders) and is a four-cycle engine. As shown in FIG. 17, the engine E is mounted such that a crankshaft 9 extends along the longitudinal direction of the body 1. An output end of the crankshaft 9 is rotatably coupled integrally with a pump shaft 12 of a water jet pump P through a propeller shaft 10. An impeller 11 is attached on the pump shaft 12 of the water jet pump P. The impeller 11 is covered with a pump casing 13 on the outer periphery thereof. A water intake 14 is provided on a bottom of the hull 2. The water is sucked and taken in from the water intake 14 and fed to the water jet pump P through a water intake passage. The water jet pump P pressurizes and accelerates the water. The pressurized and accelerated water is discharged through a pump nozzle 15 having a cross-sectional area of flow that gradually reduces in a rearward direction, and from an outlet port 16 provided on the rear end of the pump nozzle 15, thereby obtaining a propulsion force.

Fairing vanes 17 are provided behind the impeller 11 in the pump casing 13, for fairing a water flow inside the water jet pump P. A bar-type steering handle 18 is provided on a fore part of the watercraft. By operating the steering handle 18 to the right or to the left, the steering nozzle 20 provided behind the pump nozzle 15 swings to the right or to the left through a wire cable 19 indicated by a dashed line in FIG. 18. Thereby, the watercraft can be turned to any desired direction while the water jet pump P is generating the propulsion force. The handle 18 is provided with a throttle lever 21 for adjusting an engine speed of the engine E.

As shown in FIG. 17, a bowl-shaped reverse deflector 19 is provided above the rear side of the steering nozzle 18 such that it can swing downward around a horizontally mounted swinging shaft 19*a*. The deflector 19 is swung downward toward a lower position behind the steering nozzle 18 to deflect the water ejected from the steering nozzle 18 forward, and as the resulting reaction, the personal watercraft moves rearward.

As shown in FIGS. 17 and 18, a rear deck 24 formed at a stern part of the watercraft is provided with an operable hatch cover 25. A rear compartment with a small capacity is provided under the hatch cover 25. A front hatch cover 26 is provided on the fore part of the watercraft. A front compartment (not shown) is provided under the front hatch cover 26 for storing equipment and the like.

Embodiment 1

Figure 1:
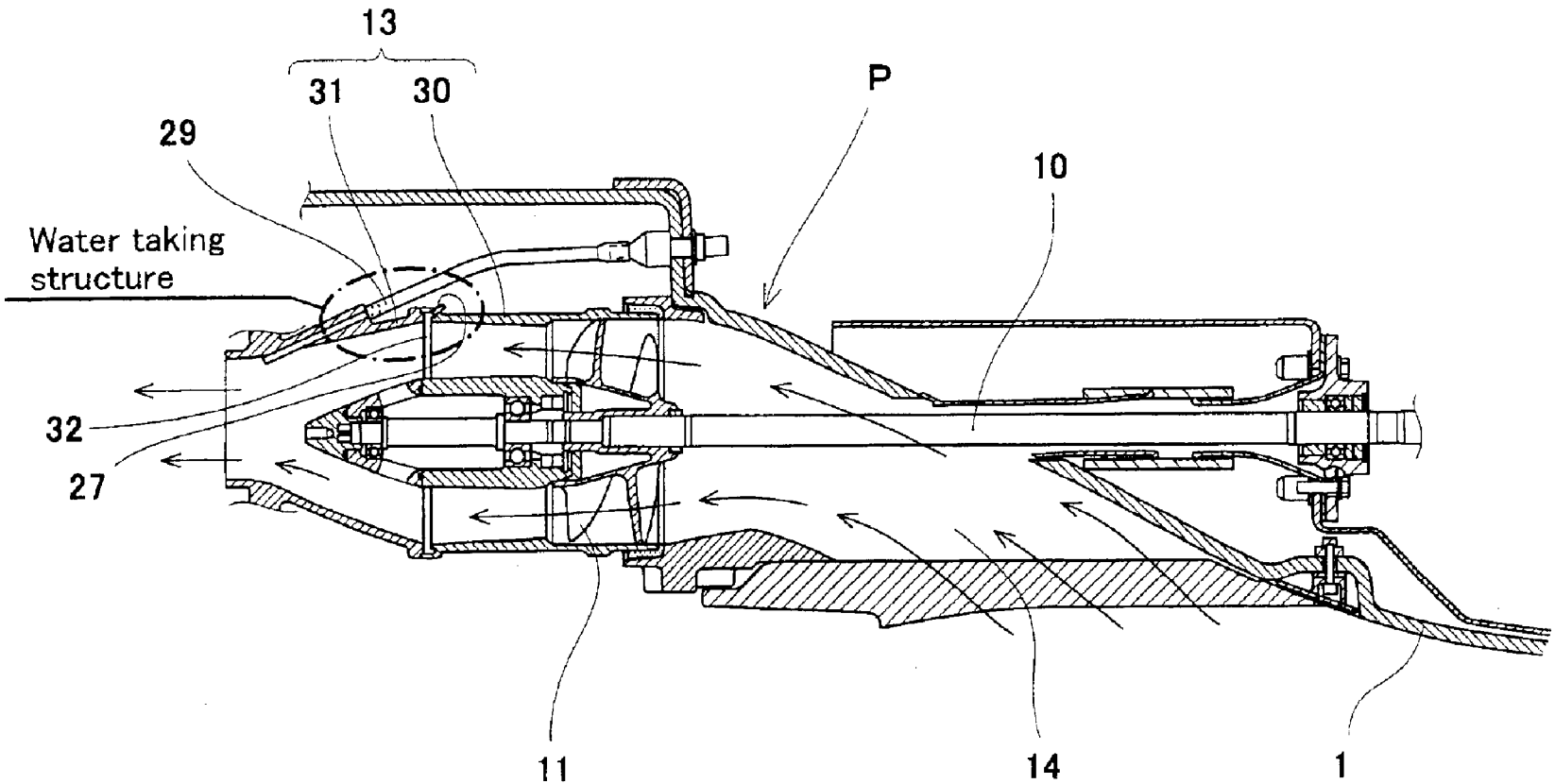
FIG. 1 is a side cross-sectional view showing a structure of a water jet pump of a personal watercraft according to an embodiment of the present invention.

As shown in FIG. 1, a cooling water outlet 27 for drawing cooling water is provided in the positive-pressure region inside the water jet pump P, for example, at a position behind the impeller 11 inside the water jet pump P, to supply the cooling water to components such as the engine E (FIGS. 17 and 18) and an exhaust system (exhaust manifold, muffler, and the like) of the watercraft.

Figure 2A:
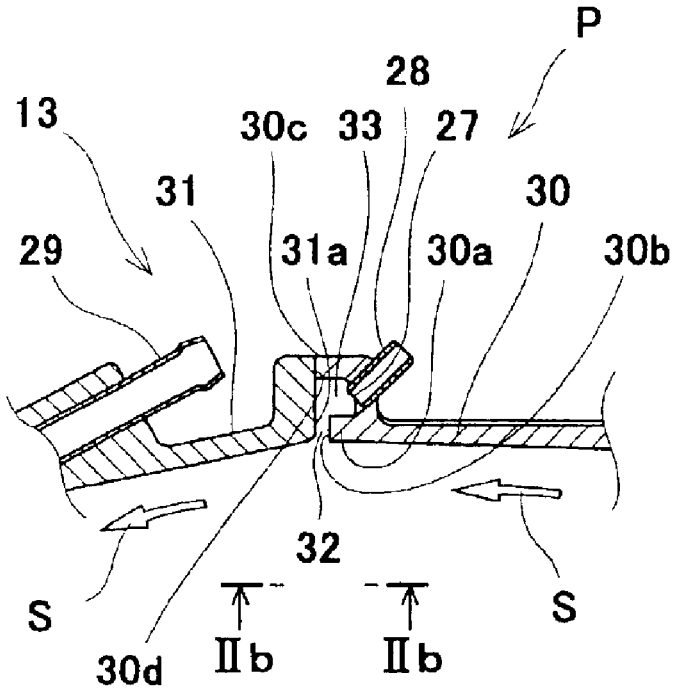
Figure 2B:
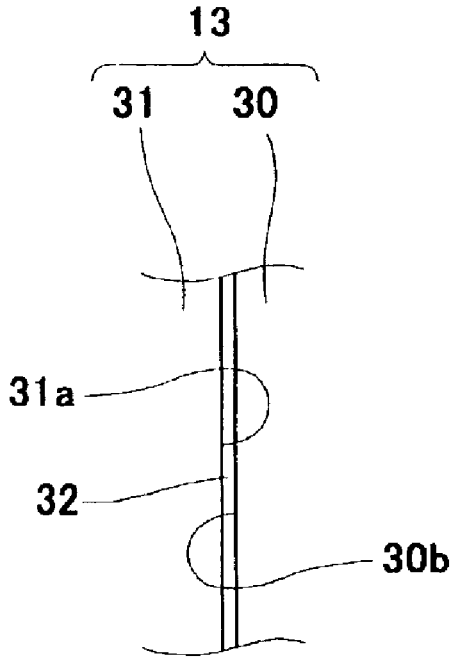

The cooling water outlet 27 communicates with a water drawing passage 32 through a water reserving passage 33 (FIGS. 2A, 3A) mentioned in detail later. The water drawing passage 32 is provided in a connecting face between a front casing 30 and a rear casing 31 constituting a pump casing 13 in FIG. 1 to be rectangular and long in a circumferential direction of the pump casing 13, as shown in FIGS. 2A and 2B, and serves to introduce water therethrough. The front casing 30 contains the impeller 11 and the rear casing 31 is provided continuously behind the front casing 30.

As shown in FIGS. 1 and 2, a rear end portion of the front casing 30 has a double-walled structure constituted by an inner wall 30*a* and an outer wall 30*c*. The water drawing passage 32 extends over a predetermined range in the circumferential direction between a rear end 30*b* of the inner wall 30*a* and a front end 31*a* of the rear casing 31 that protrudes outwardly in the form of a flange. A rear end 30*d* of the outer wall 30*c* of the front casing 30 and an outer portion of the front end 31*a* of the rear casing 31 are in contact with each other so as to seal water.

The water reserving passage 33, which is ring-shaped, extends over a predetermined range in the circumferential direction of the pump casing 13 between the inner wall 30*a* and the outer wall 30*c* of the front casing 30 so as to communicate with the water drawing passage 32. The cooling water outlet 27 opens to the water reserving passage 33, and an opening end of a water supply pipe 28 of the watercraft is connected to the cooling water outlet 27.

Figure 8:
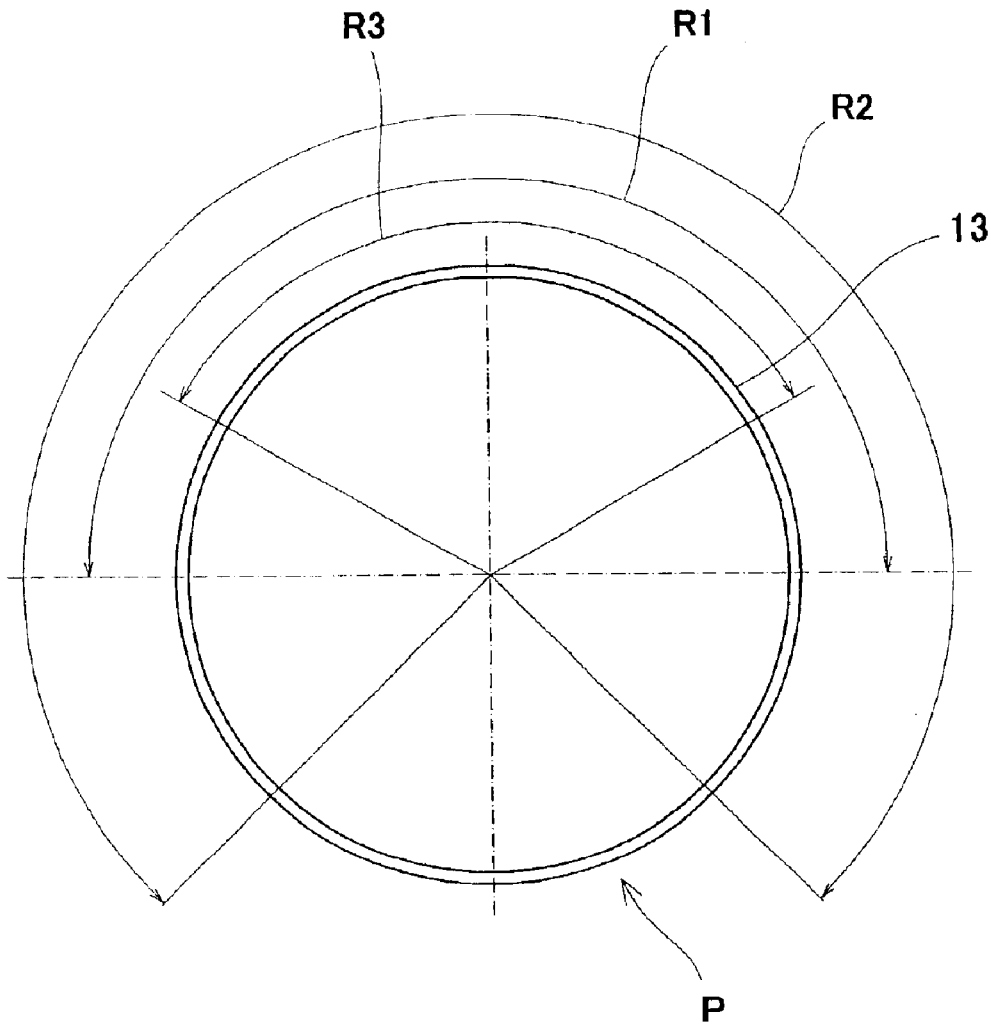
FIG. 8 is a schematic view of a transverse section of the water jet pump, showing a circumferential portion (region) of the pump casing where water drawing passages in FIGS. 2 to 7 are provided.

The water drawing passage 32 and the water reserving passage 33 may be provided over the entire periphery of the pump casing 13 or over the predetermined range thereof. The range and width of the water drawing passage 32 may be suitably selected depending on the amount of cooling water to be taken. For example, as shown in FIG. 8, the passages 32, 33 may extend in an angular range R1 of 180 degrees in an upper-half portion of the entire periphery of the pump casing 13, or otherwise in an angular range R2 of 135 degrees from an upper-most position of the casing 13 toward each of clockwise and counterclockwise directions, because a large quantity of sand, small stones, or the like reside in the vicinity of the bottom portion inside the water jet pump P. In particular, by providing the water drawing passage 32 within an angular range R3 of 60 degrees from the upper-most position toward each of clockwise and counterclockwise directions, advantageously, massive substances such as small stones or sand which have entered the inside of the water jet pump P are less likely to enter the water drawing passage 32 even if these substances are drawn up by water flow while the engine E is starting.

The high-pressure water (S indicates flow of the water) that has passed through the impeller 11 (see FIG. 17) inside the water jet pump P flows into the water reserving passage 33 through the water drawing passage 32, and from the water reserving passage 33, a required amount of water is taken through the cooling water outlet 27. The water is supplied as cooling water to the components such as the engine E through the supply pipe 28 such as a hose connected to the cooling water outlet 27. The water drawing passage 32 and the water reserving passage 33 are substantially co-extensive, but this is only illustrative. For example, the water reserving passage 33 may be larger than the water drawing passage 32, or otherwise this relationship may be reversed. As shown in FIGS. 1 and 2, the rear casing 31 is provided with a pipe 29 through which bilge inside the body 1 is discharged.

Embodiment 2

Figure 3A:
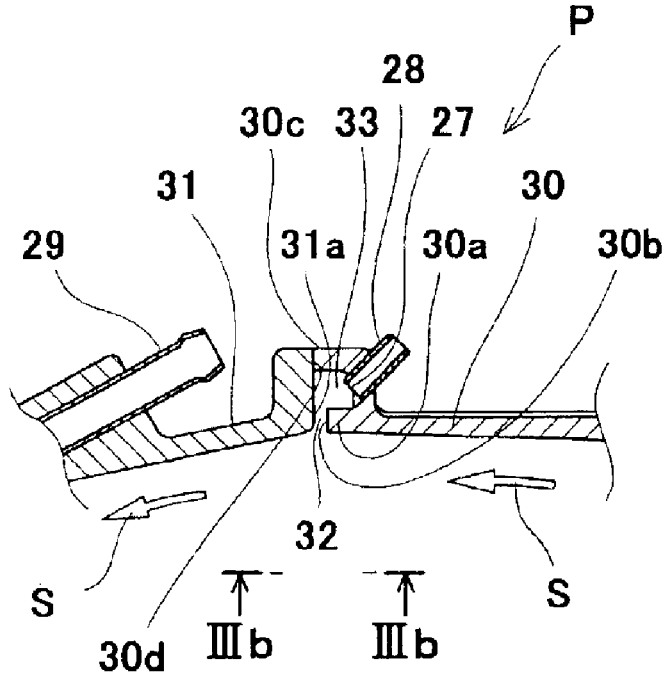
Figure 3B:
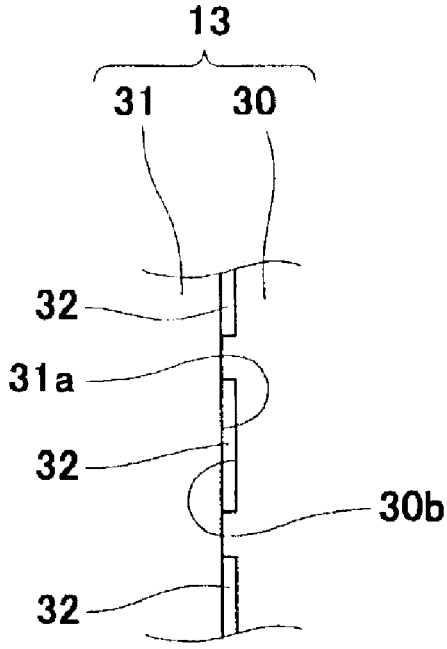

A second embodiment shown in FIGS. 3A and 3B differs from the first embodiment in that the rear end 30*b* of the inner wall 30*a* of the front casing 30 is in contact with the front end 31*a* of the rear casing 31 intermittently in the circumferential direction so that the water drawing passages 32 which are rectangular and long in the circumferential direction are provided at plural positions, spaced apart at predetermined intervals. Also in this structure, in order to lead the water taken through the water drawing passages 32 to the cooling water outlet 27, the water reserving passage 33 is located radially outward of the water drawing passages 32 so as to extend in the circumferential direction and so as to allow these passages 32 to communicate with one another. The other respects are identical to those of the first embodiment, and therefore, in FIGS. 3A and 3B, the same reference numerals as those in FIGS. 2A and 2B are used to identify the same or corresponding parts, which will not be further described.

Embodiment 3

Figure 4A:
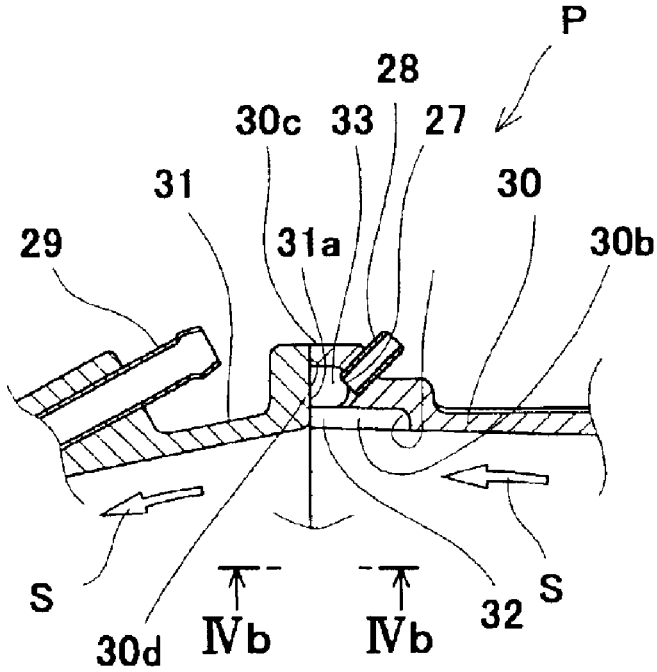
Figure 4B:
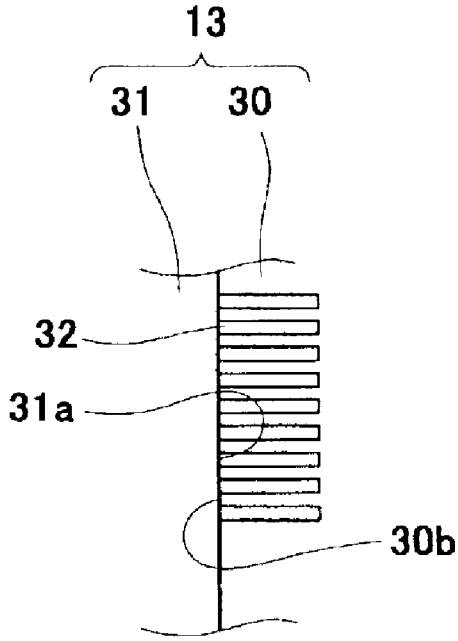

In a third embodiment in FIGS. 4A and 4B, the inner wall 30*a* of the front casing 30 is comb-shaped as seen from an inner peripheral face of the front casing 30, and the comb-shaped rear end 30*b* of the inner wall 30*a* is in contact with the front end 31*a* of the rear casing 31. In this structure, the comb-shaped cut-outs (slits) serve as the water drawing passages 32. Also in this structure, the water drawing passages 32 are provided at plural positions apart at predetermined intervals in the circumferential direction, but these passages 32 are rectangular and elongate in the longitudinal direction of the pump casing 13. The water drawing passages 32 communicate with one another through the water reserving passage 33 located radially outward of the water drawing passages 32.

In contrast to the first or second embodiment, in the structure in FIGS. 4A and 4B, the inner wall 30*a* of the front casing 30 is in contact with the rear casing 31 at a number of positions. Therefore, preferably, strength in the portion where the front casing 30 is connected to the rear casing 31 is increased. In FIGS. 4A and 4B, the same reference numerals as those in FIGS. 2A and 2B are used to identify the same or corresponding parts.

Embodiment 4

Figure 5A:
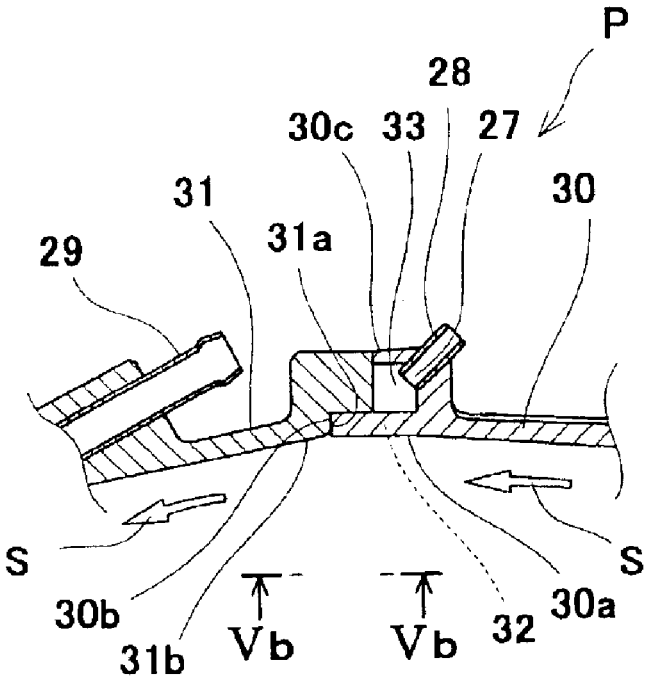
Figure 5B:
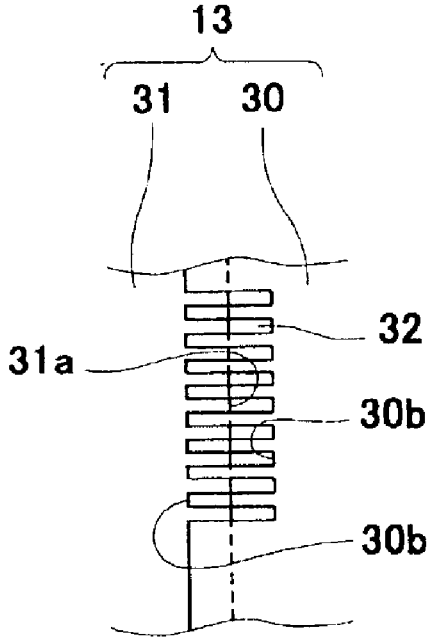

In a fourth embodiment in FIGS. 5A and 5B, the rear end 30*b* of the inner wall 30*a* of the front casing 30 is comb-shaped within a predetermined range in the circumferential direction of the casing 13, thereby forming comb-shaped water drawing passages 32, and the rear end 30*b* is located rearward of the outer wall 30*c* in the longitudinal direction (left in FIG. 5). To permit the rear end 30*b* of the inner wall 30*a* to engage with the front end 31*a* of an inner peripheral face 31*b* of the rear casing 31, the front end 31*a* of the inner peripheral face 31*b* is cut out to conform to the rear end 30*b*.

The comb-shaped water drawing passages 32 may be continuous or spaced apart from one another over a predetermined range in the circumferential direction of the water jet pump P according to the amount of cooling water to be taken so that a required opening area is obtained. As in the above embodiments, the water drawing passages 32 communicate with one another through the water reserving passage 33 located radially outward of the passages 32.

In contrast to the structure in the third embodiment, in this structure, more preferably, the strength in the portion where the front casing 30 is connected to the rear casing 31 is further increased because the inner wall 30*a* of the front casing 30 is in contact with the rear casing 31 at its rear end face and outer peripheral face, and is thereby securely retained. In FIGS. 5A and 5B, the same reference numerals as those in FIGS. 2A and 2B are used to identify the same or corresponding parts.

Embodiment 5

Figure 6A:
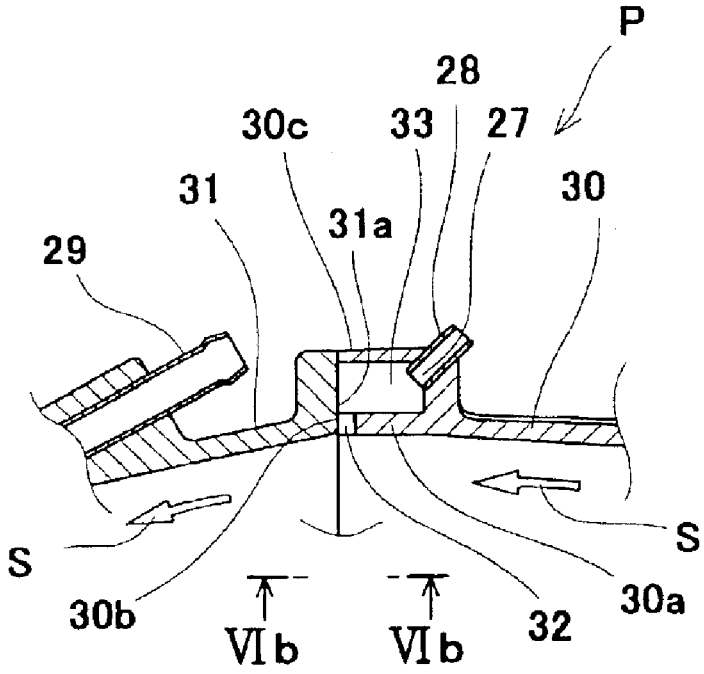
Figure 6B:
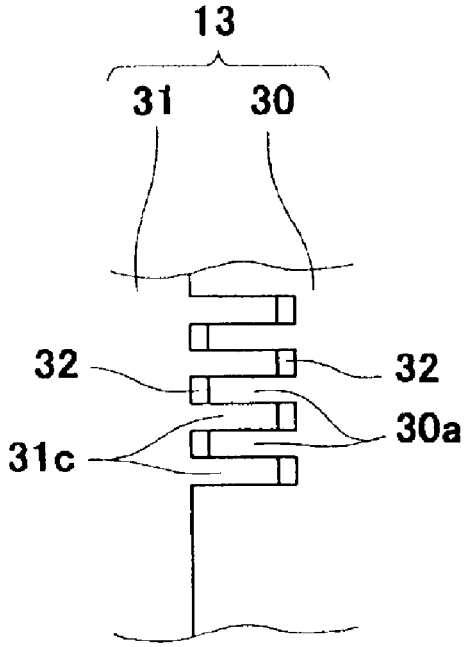

In a fifth embodiment in FIGS. 6A and 6B, the inner wall 30*a* of the front casing 30 is comb-shaped and an inner peripheral portion 31*c* of the front end 31*a* of the rear casing 31 protrudes in the shape of comb toward the front casing 30 so as to engage with the comb-shaped inner wall 30*a*. The cut-outs (slits) of the comb shape in the inner wall 30*a* are longer than solid portions of the comb shape, and rectangular water drawing passages 32 are each formed in the state in which each of the cut-outs and the corresponding solid portion are in engagement with each other. In other words, the water drawing passages 32 are formed between the rear end 30*b* of the inner wall 30*a* and the front end 31*a* of the rear casing 31. The water drawing passages 32 may be formed continuously or spaced apart from each other over a predetermined range in the circumferential direction of the water jet pump P according to the amount of the water to be taken. As in the above embodiments, the water drawing passages 32 communicate with one another through the water reserving passage 33 located radially outward of the passages 32.

In contrast to the third and fourth embodiments, in this structure, since the inner wall 30*a* of the front casing 30 engages with the rear casing 31, strength between the portion where the front casing 30 is connected to the rear casing 31 is preferably increased. In FIGS. 6A and 6B, the same reference numerals as those in FIGS. 2A and 2B are used to identify the same or corresponding parts.

Embodiment 6

Figure 7A:
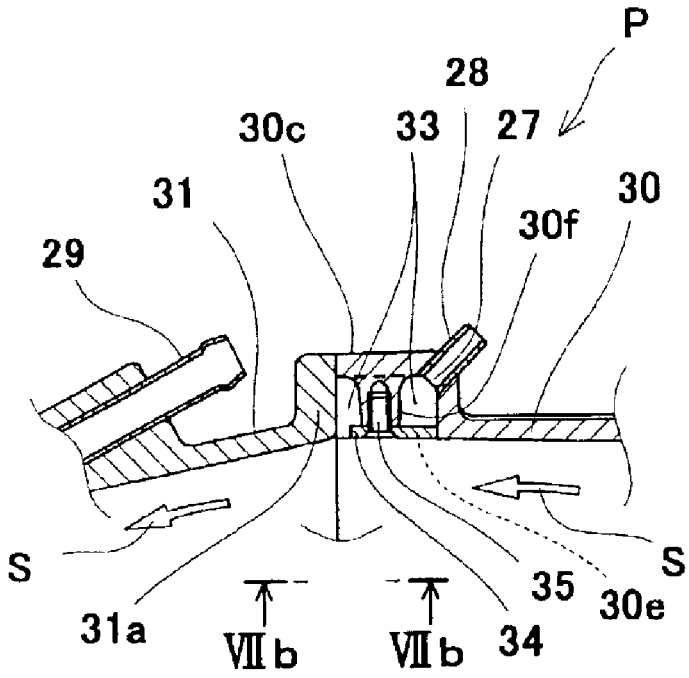
Figure 7B:
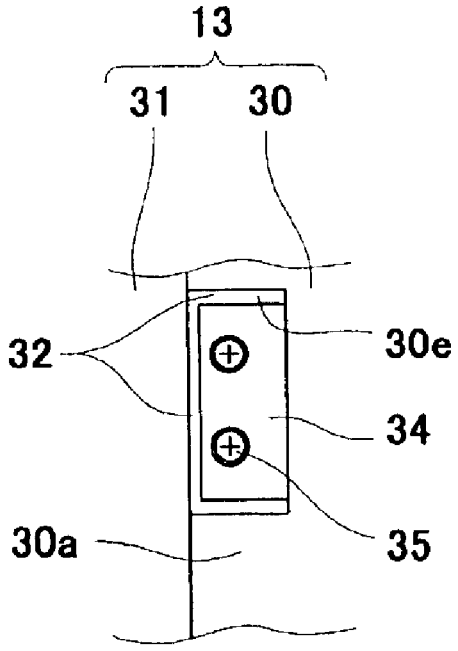

In a sixth embodiment in FIGS. 7A and 7B, the inner wall 30*a* of the front casing 30 is partially cut out to form a rectangular opening 30*e*, and the other portion of the inner wall 30*a* extends to the same position as the outer wall 30*c* to be in contact with the front end 31*a* of the rear casing 31. A lid member 34 is attached to a portion 30*f* protruding inwardly from the outer wall 30*c* by means of a bolt 35. The lid member 34 is slightly smaller than an opening area of the opening 30*e* to create a U-shaped water drawing passage 32 on its periphery thereof.

In this structure, the U-shaped opening formed between the rectangular opening 30*e* and the lid member 34 becomes the water drawing passage 32. This structure is advantageous in that a mold for forming the water drawing passage 32 is simplified. As in the above embodiments, the water reserving passage 33 is provided between the outer wall 30*c* and the inner wall 30*a* of the front casing 30 and the front end 31*a* of the rear casing 31 that protrudes outwardly in the shape of flange so as to communicate with the water drawing passage 32. Such structures may be provided at intervals over the entire pump casing 13 in the circumferential direction thereof or at plural positions. In FIGS. 7A and 7B, the same reference numerals as those in FIGS. 2A and 2B are used to identify the same or corresponding parts.

As should be appreciated from the first to sixth embodiments, the water drawing passage 32 is obtained merely by setting a relative dimensional relationship between two parts, i.e., the front casing 30 and the rear casing 31, to form the slit in the portion where these casings 30, 31 are connected to each other. The water drawing passage 32 is obtained with fewer parts and without additional process.

When the front casing 30 and the rear casing 31 are cast, machining process of the water drawing passage 32 becomes unnecessary. So, these casings are manufactured easily and at a reduced cost. Since the water drawing passage 32 has a small opening area and is located in the upper portion of the pump casing 13 or in the portion other than the bottom portion thereof, the cooling water inside the water jet pump P is taken from the cooling water outlet 27 without the substances such as sand, small stones or water borne plants.

The water drawing passages 32 may be provided over the entire periphery of the pump casing 13 of the water jet pump P. Preferably, as shown by an arrow R2 in FIG. 8, the water drawing passages 32 are provided at positions other than the bottom portion of the water jet pump P. More preferably, as shown by an arrow R1 in FIG. 8, the water drawing passages 32 are provided in an upper half portion of the water jet pump P. This is because water without relatively heavy substances such as sand and small stones is taken through the water drawing passage. More preferably, by providing the water drawing passages 32 within an angular range R3 of 60 degrees from the upper most position of the pump casing 13 toward each of the clockwise and counterclockwise directions, advantageously, large-sized particulates such as stones and sand are less likely to enter the water drawing passages 32 even when these substances are drawn up by water flow.

In each of the above embodiments, further, a filter may be provided between the outer wall 30*c* and the inner wall 30*a* of the front casing 30. The filter is capable of filtering the water containing smaller-sized particulates and other substances that have passed through the water drawing passage 32.

In each of the embodiments, the structure of the front casing 30 and the structure of the rear casing 31 may be reversed.

While the water drawing passages 32 and the water reserving passage 33 are formed at the portion where the front casing 30 and the rear casing 31 constituting the pump casing 13 are connected to each other, they may be formed in other suitable locations in the casing forming a flow path in the positive-pressure region of the water jet pump P, including pump casings connected between the impeller and the fairing vanes, and other connected portions.

Embodiment 7

Figure 9A:
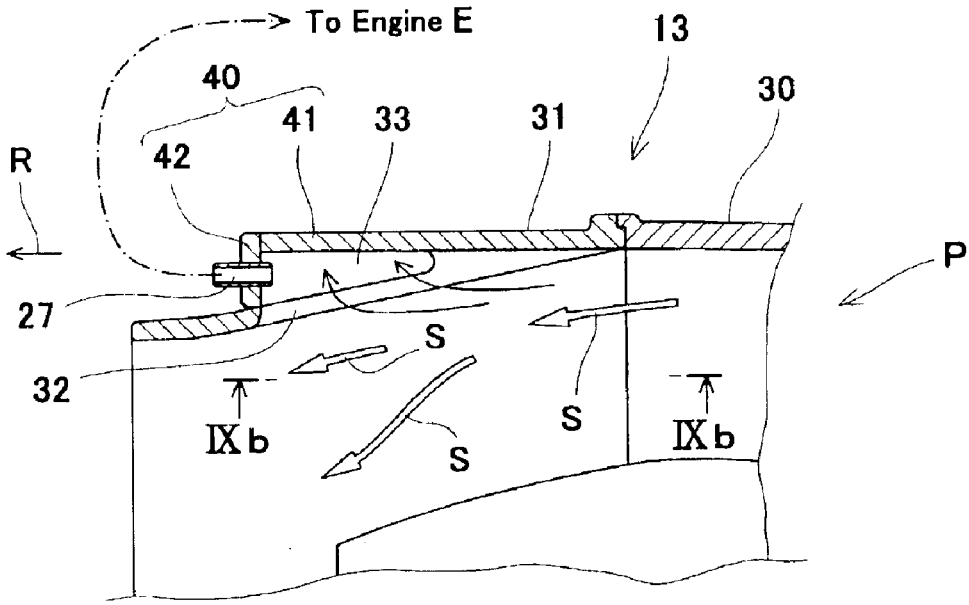
Figure 9B:
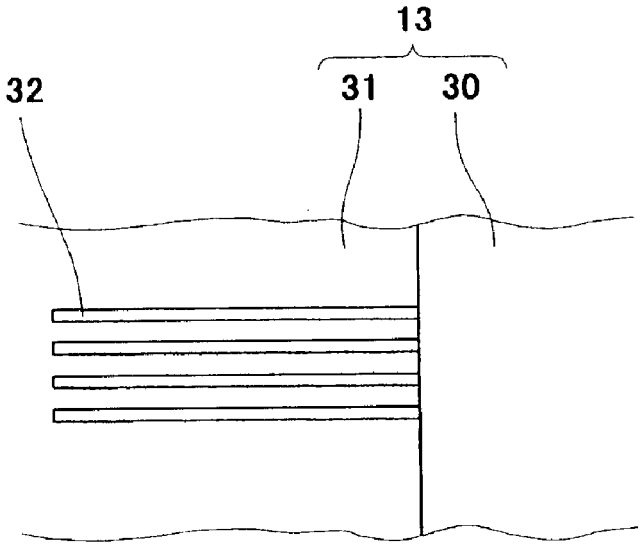

As shown in FIG. 9A or 9B, a plurality of slit-shaped water drawing passages 32 (openings) are formed in the rear casing 31 in the circumferential direction so as to extend rearward from the front end of the rear casing 31 (e.g., a pump nozzle in this embodiment) of the pump casing 13. The rear casing 31 is formed in an inclined shape to have the cross-sectional area gradually reduced rearward and the inner side thereof is located in the positive-pressure region of the water jet pump P. The water drawing passages 32 are of a rectangular narrow band shape and extend rearward and in parallel with one another. A cover 40 is provided adjacent to the rear end of the front casing 30 to cover the water drawing passage 32.

The cover 40 is comprised of a horizontal wall 41 extending horizontally from the rear end of the front casing 30 and a vertical wall 42 extending vertically from the rear end of the horizontal wall 41 between the horizontal wall 41 and the rear casing 31. The vertical wall (removable wall) 42 is removably attached as mentioned later. A space having a triangular cross section is provided between the cover 40 and the inclined rear casing 31 and serves as the water reserving passage 33. Each of the slit-shaped water drawing passages 32 communicates with the water reserving passage 33.

The removable wall 42 is movable rearward as indicated by an arrow R in FIG. 9A. The removable wall 42 is provided with the cooling water outlet 27 for drawing the cooling water. A water supply pipe (not shown) is connected to the cooling water outlet 27 to supply the cooling water to the components such as the engine E and the exhaust system. The rear casing 31 is located on the rear side of the watercraft, i.e., on the outer side of the watercraft, as in the structures shown in FIGS. 16A, 16B.

Figure 10A:
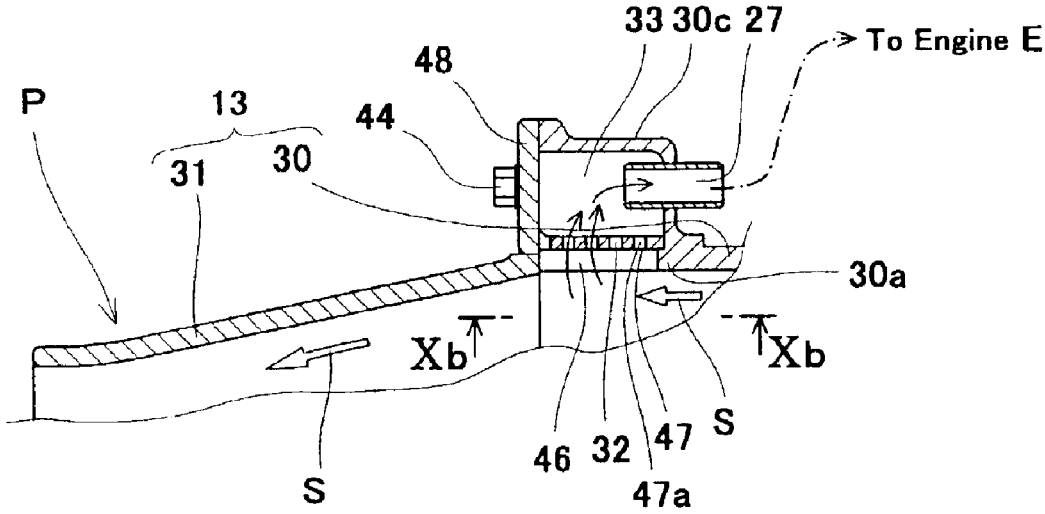
Figure 10B:
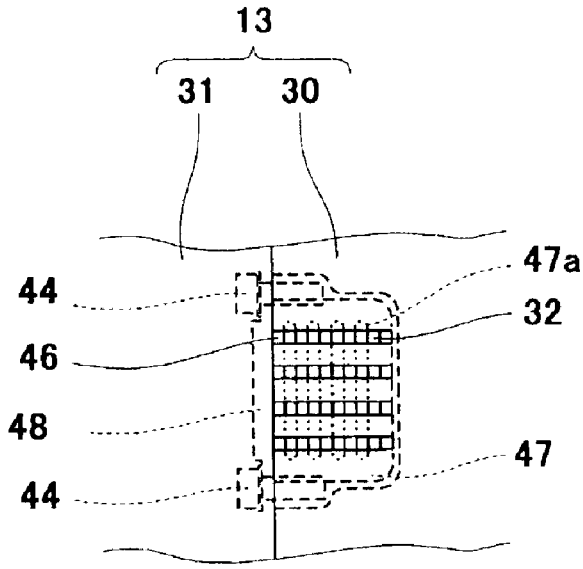
Figure 16A:
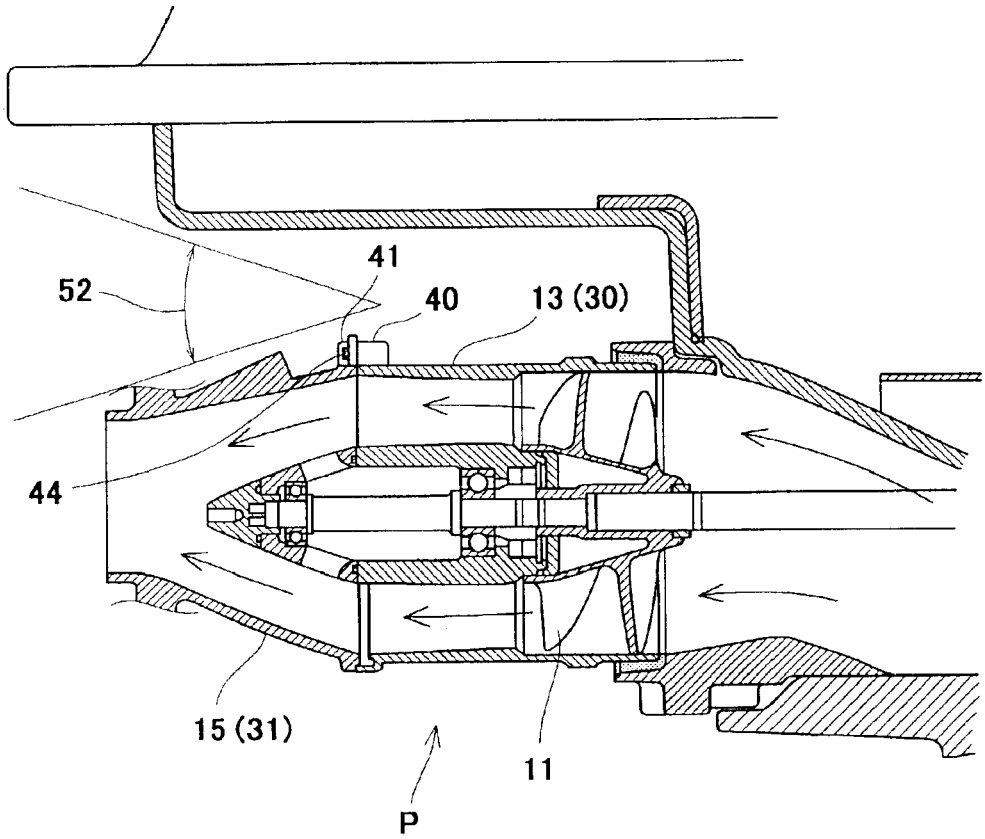
Figure 16B:
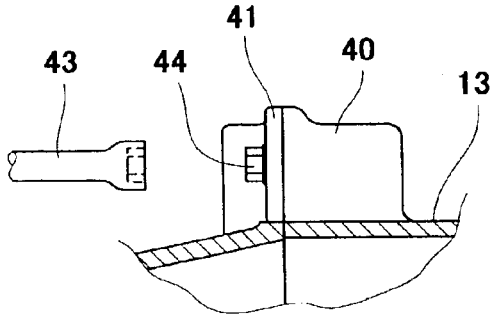

The vertical wall 42 at the rear end of the cover 40 may be attached by means of bolts 44 as shown in FIGS. 10A and 10B or 16B, or otherwise, may be engaged by means of a spring (not shown).

In this structure, if substances such as water borne plants enter the water reserving passage 33 through the slit-shaped water drawing passages 32, removal of these substances can be easily accomplished in such a manner that the removable wall 42 at the rear end of the cover 40 is removed by removing the bolts 44 or the like by using an operator's hand or a tool (box wrench with extension bar) 43 from outside the watercraft and extending the hand or the tool into the exposed water reserving passage 33. In FIG. 16A, an angle 52 represents a range within which the tool 43 can approach.

Embodiment 8

In an eighth embodiment in FIGS. 10A and 10B, the water drawing passages 32 and the water reserving passage 33 communicating with the water drawing passages 32 are provided at the rear end portion inside the front casing 30 of the pump casing 13, the inner side of which becomes the positive-pressure region of the water jet pump P.

Specifically, a double wall comprised of the inner wall 30*a* and the outer wall 30*c* of the front casing 30 is provided at the rear portion of the front casing 30 and a plurality of slit-shaped openings 46 are arranged in the inner wall 30*a* to extend to the rear end thereof in parallel with one another. A slit plate (baffle plate) 47 is disposed on an upper surface of the inner wall 30*a* to have slit openings 47*a* crossing the slit-shaped openings 46. The slit-shaped openings 46 and the slit openings 47*a* of the slit plate 47 overlap with each another, thereby forming grate-shaped water drawing passages 32. A vertical wall (removable wall) 48 is removably attached to the front casing 30. To seal the water reserving passage 33 formed between the inner wall 30*a* and the outer wall 30*c*, the removable wall 48 is configured such that its upper end is in contact with the outer wall 30*c* and its rear end is in contact with the front end of the rear casing 31.

The slit plate (baffle plate) 47 is independent of the removable wall 48 and is fitted from the direction of the aft of the watercraft by using a restricting means such as horizontally extending grooves in a side wall continuous with the outer wall 30*c*. The slit plate 47 may be integral with the removable wall 48 to allow the plate 47 and the vertical wall 48 to be removed together.

In the above structure, water flowing through the inside of the water jet pump P is led into the water reserving passage 33 through the water drawing passages 32 formed by the openings 46 and the slit plate 47. The cooling water is supplied to the components such as the engine E or the like from the cooling water outlet 27 that opens in the water reserving passage 33.

With this structure, substances such as water borne plants contained in the water are prevented from entering through the water drawing passages 32 having small opening areas formed by the openings 46 and the slit openings 47*a* of the slit plate 47. The substances, even if they have entered through the water drawing passage 32, can be easily removed as follows. First, the removable wall 48 is pulled out rearward by the operator's hand or the like from behind the watercraft (left in FIGS. 10A, 10B). Then, the slit plate 47 is moved rearward to be removed. When the slit plate 47 is integral with the removable wall 48, the slit plate 47 is removed more easily. Thereby, substances such as the water borne plants residing in the slit plate 47 or in the water reserving passage 33 can be easily removed. In FIGS. 10A and 10B, the same reference numerals as those in FIGS. 9A and 9B are used to identify the same or corresponding parts.

Embodiment 9

Figure 11:
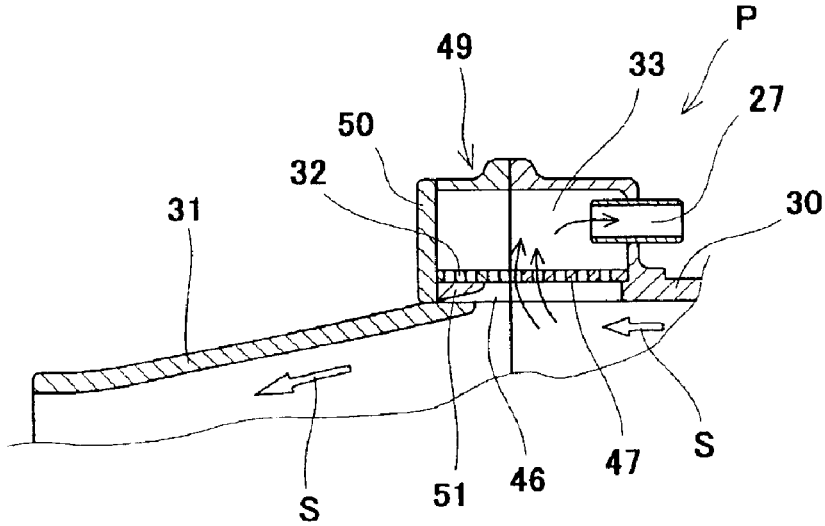
FIG. 11 is a partial side cross-sectional view of a rear end portion of the water jet pump, including the portion marked by the dashed line in FIG. 1, according to a ninth embodiment.

A ninth embodiment in FIG. 11 is basically identical to the eighth embodiment in FIGS. 10A and 10B in the structure for forming the water drawing passage and arrangement of the slit plate or the like. But, in the structure of the ninth embodiment, the opening 46, and the water reserving passage 33 and the cover 49 located above the opening 46 exist on both of the front casing 30 and the rear casing 31. In addition, a removable wall 50 is attached to a rear end of a cover 49 in a different way.

Instead of the bolt, the removable wall 50 is engaged by an engagement portion 51 having a spring function (elasticity). The removable wall 50 is easily engaged/disengaged merely by pushing or pulling out the wall 50. In this structure, as in the eighth embodiment, the substances existing in the slit plate 47, the water reserving passage 33, or the like can be easily removed. In FIG. 11, the same reference numerals as those in FIGS. 9A and 9B or 10A and 10B are used to identify the same or corresponding parts.

Figure 14A:
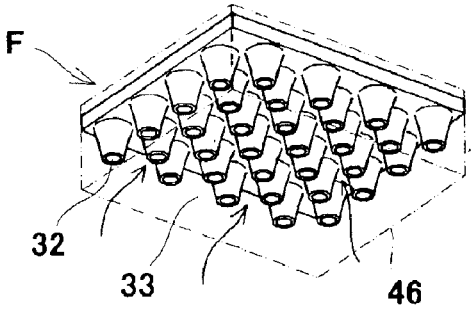
FIGS. 14A to 14F are perspective views showing structures of filter members applied to the embodiments in FIGS. 12A and 12B or 13A and 13B.
Figure 14B:
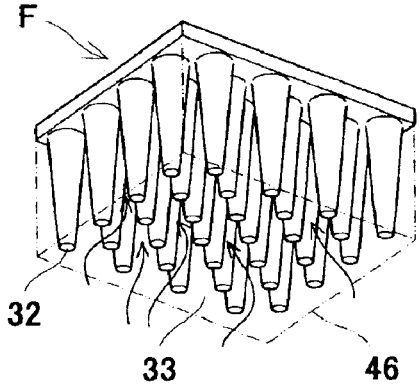
Figure 14C:
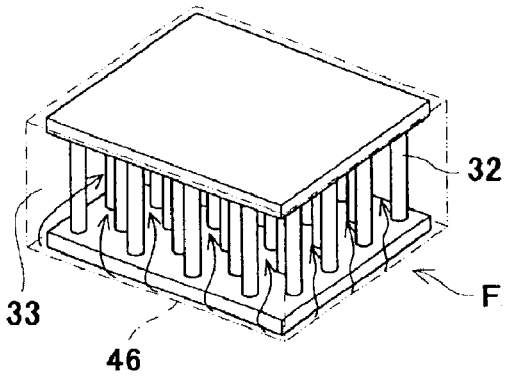
Figure 14D:
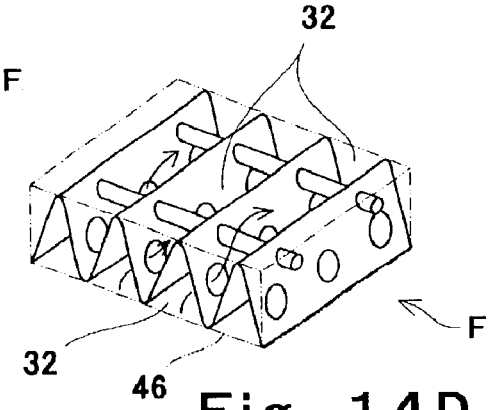
Figure 14E:
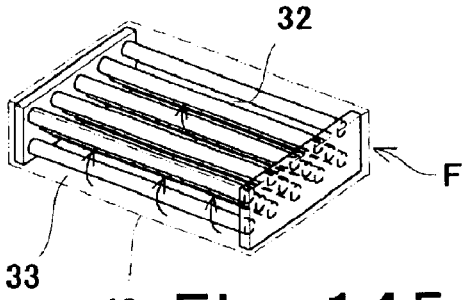
Figure 14F:
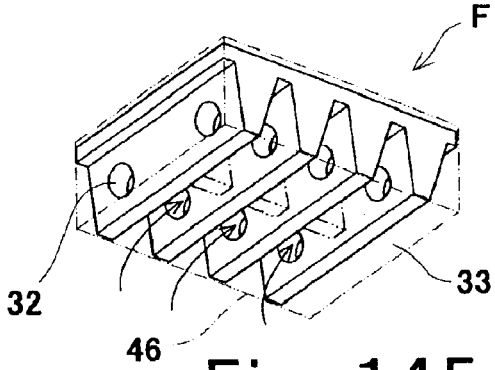

In the seventh to ninth embodiments, a filter member F shown in FIGS. 14A to 14F may be provided in the water reserving passage 33 located above the opening 46 such that the filter member F is suitably directed in view of a direction of water flow. The filter member F is capable of filtering the water containing substances which are to be taken from the cooling water outlet 27. FIG. 14A shows the filter member F provided with a number of hollow passages. FIGS. 14B, 14C, and 14E show filter members F, each of which is configured to have a plurality of rods having a small diameter in parallel. FIGS. 14D to 14F show filter members F provided with labyrinth-structured water drawing passages 32. In FIGS. 14A to 14F, the water flow inside the filter members is represented by arrows and configurations of the opening 46 and the water reserving passage 33 are represented by dash double-dot lines.

Embodiment 10

Figure 12:
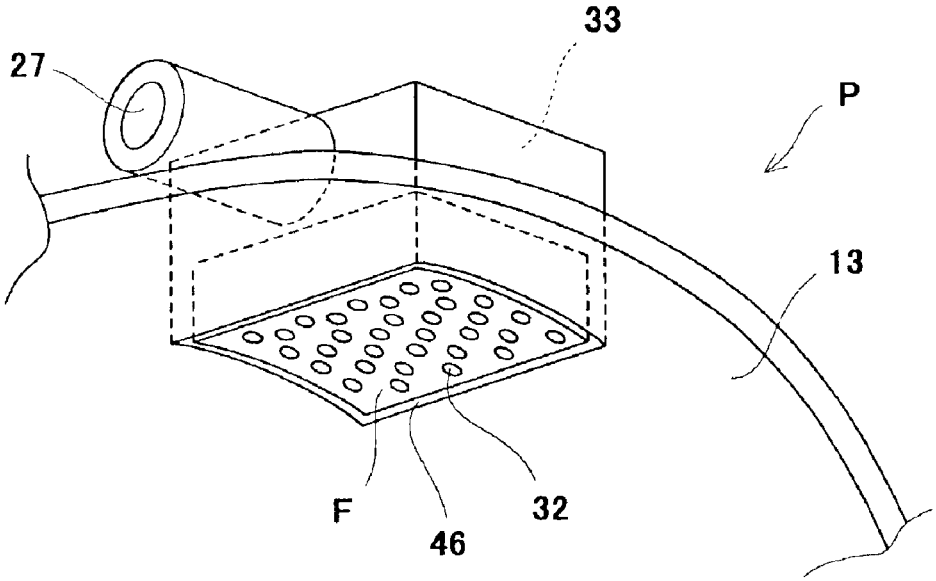
FIG. 12 is a perspective view showing a cooling water drawing structure and its vicinity of the water jet pump in the personal watercraft according to a tenth embodiment.
Figure 13:
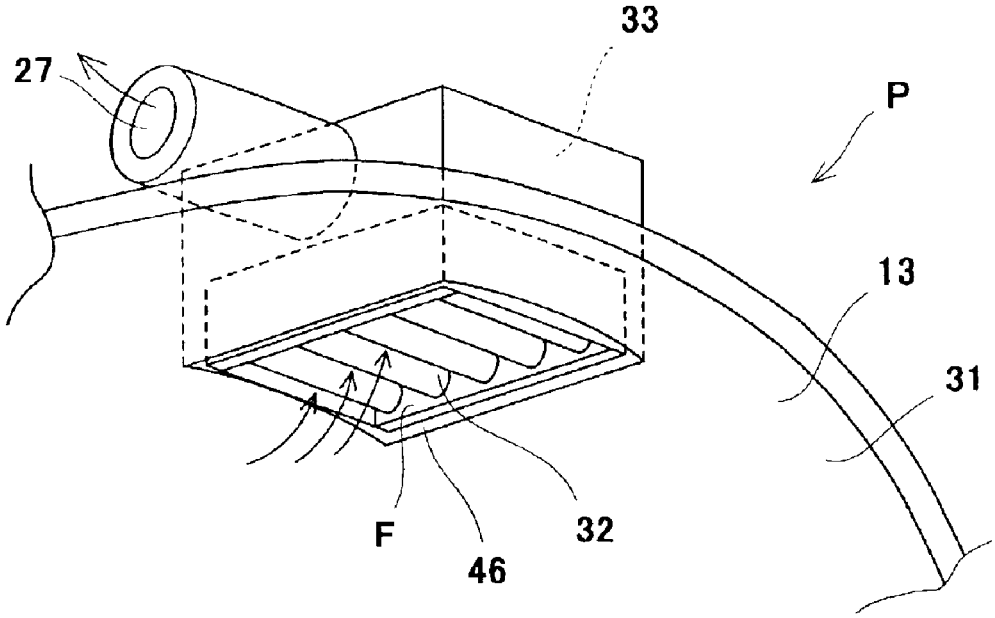
FIG. 13 is a perspective view showing another structure of the tenth embodiment.

In a tenth embodiment shown in FIGS. 12 and 13, the opening 46 that has a rectangular cross section is provided in the upper portion inside the pump casing 13 of the water jet pump P so as to communicate with the water reserving passage 33 and the filter member F is located at the opening 46 facing the water reserving passage 33.

Figure 15:
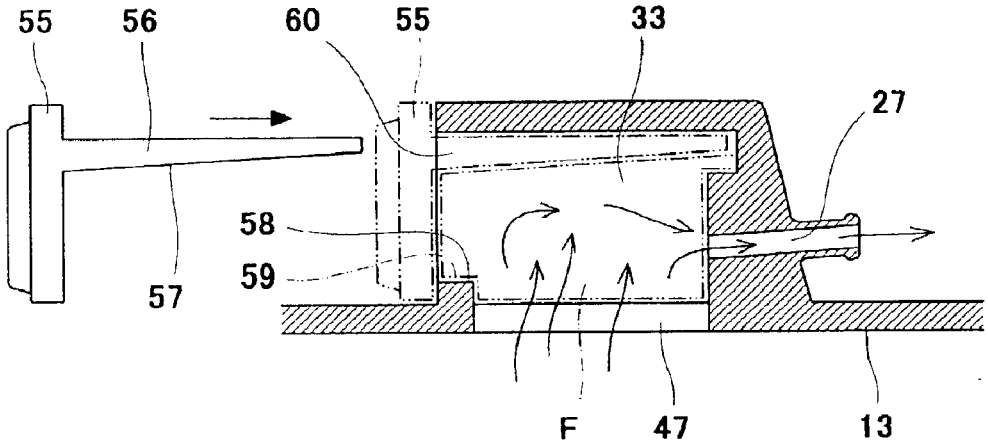
FIG. 15 is a side cross-sectional view showing a method of mounting the filter member.

The filter member F is fixed as follows. As shown in FIG. 15, a rear-end wall portion (removable wall) 55 of a wall portion constituting the water reserving passage 33 is adapted to be drawn (or pulled out) from behind. The wall portion 55 is integrally provided with a support plate 56 extending forward from the wall portion 55. The support plate 56 has an inclined lower face 57 with a thickness decreasing toward a front end side. The support plate 56 is used to hold the filter member F shown in FIGS. 14A to 14F in the water reserving passage 33 by using a wedge function thereof. More specifically, as shown by a dash double-dot line, the filter member F is provided with a convex portion 59 on its periphery that engages with a step portion 58 formed on the outer periphery of the opening 46. By inserting the support plate 56 integral with the wall portion 55 into the water reserving passage 33, the lower face 57 of the support plate 56 presses the filter member F toward the opening 46, thereby causing the filter member F to be securely retained between the opening 46 and the lower face 57. In this structure, the filter members F shown in FIGS. 14A to 14F need to be provided with the convex portion 59 in FIG. 15.

With the above structure, the filter member F is movable toward the opposite side of the opening 46 by pulling out the wall portion 55 integral with the support plate 56 rearward, and from the resulting space 60, the filter member F is taken out, and is thereafter cleaned.

The substances residing in the water reserving passage 33 are easily removed by putting the operator's hand or the tool from behind outside the watercraft.

In the structures in FIGS. 12, 13, and 15, the slit plate 47 in the eighth and ninth embodiments is unnecessary, and the opening 46 is rectangular. In these structures, means for fixing the filter member F inside the water reserving passage 33, for example, the above identified holding structure (wall portion 55), or a bolt, a spring (not shown), and the like are needed.

As in the structures in FIGS. 16A and 16B, in the structures in FIGS. 12 and 13, substances residing in the filter member F or in the water reserving passage 33 are easily removed by putting the operator's hand or the tool through the opening behind the pump nozzle 15.

In the structures in FIGS. 12, 13 and 15, the water reserving passage 33 may be provided only in the upper portion of the pump casing 13 or in the ranges shown in FIG. 8.

Numerous modifications and alternative embodiments of the invention will be apparent to those skilled in the art in view of the foregoing description. Accordingly, the description is to be construed as illustrative only, and is provided for the purpose of teaching those skilled in the art the best mode of carrying out the invention. The details of the structure and/or function may be varied substantially without departing from the spirit of the invention and all modifications which come within the scope of the appended claims are reserved.

What is claimed is:

1. A jet-propulsion watercraft, comprising:

an engine;

a water jet pump driven by the engine;

a pump casing for the water jet pump, the pump casing including a front casing joined to a rear casing at a connecting face, the rear casing being configured to lead pressurized water rearward;

at least one water drawing passage provided so as to communicate with an inside of the water jet pump, the water drawing passage being formed at the connecting face between the front casing and the rear casing ; and an engine component cooled by water as cooling water is taken through the water drawing passage.

2. The jet-propulsion watercraft according to claim 1, wherein the front casing contains an impeller of the water jet pump.

3. The jet-propulsion watercraft according to claim 1, wherein the rear casing has a pump nozzle of the water jet pump.

4. The jet-propulsion watercraft according to claim 1, wherein the water drawing passage is formed in the shape of a slit in the connecting face between the front casing and the rear casing.

5. The jet-propulsion watercraft according to claim 4, wherein the water drawing passage is one of a plurality of water drawing passages that are provided at plural positions spaced intermittently in a circumferential direction of the water jet pump.

6. The jet-propulsion watercraft according claim 5, wherein the water drawing passages provided at plural positions communicate one another through the water reserving passage.

7. The jet-propulsion watercraft according to claim 1, further comprising:

a water reserving passage located radially outward of the water drawing passage so as to communicate with the water drawing passage, the water reserving passage including a space surrounded by an outer wall of the pump casing at the connecting face between the front casing and the rear casing of the pump casing, wherein a cooling water outlet for drawing the water is provided in the outer wall to supply the water as the cooling water to the component.

8. The jet-propulsion watercraft according to claim 7, wherein the space forming the water reserving passage has an opening facing rearward, the opening being covered with a removable wall.

9. The jet-propulsion watercraft according to claim 8, further comprising a baffle plate provided in the space of the water reserving passage, wherein the baffle plate is removable through the opening.

10. The jet-propulsion watercraft according to claim 8, further comprising a filter member provided in the space of the water reserving passage, wherein the filter member is removable through the opening.

11. The jet-propulsion watercraft according to claim 1, wherein an opening of the water drawing passage is located in an upper portion of the pump casing and above a center of the water jet pump.

12. A jet-propulsion watercraft, comprising:

an engine;

a water jet pump driven by the engine;

a pump casing for the water jet pump, the pump casing having two parts;

at least one water drawing passage provided so as to communicate with an inside of the water jet pump in a portion where the two parts are connected to each other; and a component cooled by water as cooling water is taken through the water drawing passage;

wherein the water drawing passage is formed in the shape of a slit in a connecting face between the front casing and the rear casing.

13. A jet-propulsion watercraft comprising:

an engine;

a water jet pump driven by the engine;

an opening provided in a casing of the water jet pump to communicate with an inside of the pump;

a water reserving passage communicating with the opening;

a component cooled by water taken through the opening;

a cover provided over the water reserving passage from outside;

a cooling water outlet provided in the cover, to supply the water as cooling water to the component; and a removable wall constituted by at least part of the cover that is removable by being moved in a longitudinal direction of the watercraft;

wherein the casing of the water jet pump includes two parts, and the opening is provided in a connecting face between the two parts.

14. A jet-propulsion watercraft comprising:

an engine;

a water jet pump driven by the engine;

an opening provided in a casing of the water jet pump to communicate with an inside of the pump;

a water reserving passage communicating with the opening;

an engine component cooled by water taken through the opening;

a cover provided over the water reserving passage from outside; and a cooling water outlet provided in the cover, to supply the water as cooling water to the component;

wherein the cover is provided with a maintenance opening facing rearward and allowing the water reserving passage to communicate with outside of the watercraft so as to be accessible from outside of the watercraft, and the opening is covered with a removable wall that is removable by being moved rearward in the longitudinal direction.

15. The jet-propulsion watercraft according to claim 14, further comprising a filter member provided between the opening and the cover, the filter member being removable through the maintenance opening of the water reserving passage by being moved rearward.

16. The jet-propulsion watercraft according to claim 14, further comprising a baffle plate provided between the opening and the cover, the baffle plate being removable through the maintenance opening of the water reserving passage by being moved rearward.

17. The jet-propulsion watercraft according to claim 16, wherein the baffle plate is comprised of a plate member having a slit.

18. The jet-propulsion watercraft according to claim 14, wherein the opening is slit-shaped.

19. The jet-propulsion watercraft according to claim 18, wherein the casing of the water jet pump includes two parts, and the opening is provided in a connecting face between the two parts.

20. The jet-propulsion watercraft according to claim 18, wherein the water reserving passage is located radially outward relative to the slit-shaped opening, and wherein the slit shaped opening and the water reserving passage are formed in an inclined portion of a nozzle of the water jet pump.

21. The jet-propulsion watercraft of claim 14, wherein the opening is located in an upper portion of the pump casing and above a center of the water jet pump, to allow the water to be taken therethrough.

22. The jet-propulsion watercraft according to claim 21, wherein the opening is provided within a range of 60 degrees from an uppermost position of the pump casing toward each of clockwise and counterclockwise directions.

* * * * *